US007253697B2

(12) United States Patent
Soda et al.

(10) Patent No.: US 7,253,697 B2
(45) Date of Patent: Aug. 7, 2007

(54) TWO-PORT ISOLATOR AND COMMUNICATION APPARATUS

(75) Inventors: Kazuya Soda, Hakusan (JP); Takashi Kawanami, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/551,774

(22) Filed: Oct. 23, 2006

(65) Prior Publication Data

US 2007/0046390 A1 Mar. 1, 2007

Related U.S. Application Data

(63) Continuation of application No. PCT/JP2005/013162, filed on Jul. 15, 2005.

(30) Foreign Application Priority Data

Jul. 30, 2004 (JP) ..... 2004-224167

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

2002/0014927 A1 2/2002 Makino et al.
2004/0207479 A1 10/2004 Hasegawa

FOREIGN PATENT DOCUMENTS

JP 2002-026615 1/2002
JP 2004-015430 1/2004
JP 2004-088743 3/2004

OTHER PUBLICATIONS

International Search Report issued in the corresponding International Application No. PCT/JP2005/013162, mailed on Aug. 30, 2005.

*Primary Examiner*—Stephen E. Jones
(74) *Attorney, Agent, or Firm*—Keating & Bennett, LLP

(57) ABSTRACT

A two-port isolator includes a first center electrode and a second center electrode which are wound around a ferrite to which a direct-current magnetic field is applied from permanent magnets, and the ferrite is mounted on a circuit board having built-in matching circuit devices. The ferrite is preferably substantially rectangular-parallelepiped-shaped having first and second principal surfaces that are substantially parallel to each other, and the long-side length of the principal surfaces is about 1.5 to about 5 times the short-side length. The second center electrode is wound between one and four turns around the ferrite.

17 Claims, 15 Drawing Sheets

TWO-PORT ISOLATOR AND COMMUNICATION APPARATUS

BACKGROUND OF THE INVENTION

1. Field of the Invention

The present invention relates to two-port isolators and communication apparatuses, and more specifically, to a two-port isolator and a communication apparatus used in the microwave band.

2. Description of the Related Art

In general, isolators permit signals to be transmitted only in the transmission direction while preventing transmission in the opposite direction, and are used in transmission circuit sections of mobile communication apparatuses, such as automobile telephones and portable telephones.

In the related art, Japanese Unexamined Patent Application Publication No. 2002-26615 (Patent Document 1) discloses a two-port isolator in which an assembly that is formed by winding center electrodes made of insulation-coated wires around a substantially square-shaped ferrite is disposed vertically upright on a laminated substrate. The laminated substrate includes circuit devices (capacitors, resistors, and inductors) for a matching circuit, and terminal electrodes defined thereon.

Japanese Unexamined Patent Application Publication No. 2004-15430 (Patent Document 2) discloses a two-port isolator which includes a center-electrode assembly having center electrodes defined by electrode films that are mounted on a ferrite, the two-port isolator being mounted on a laminated substrate. The laminated substrate includes circuit devices for a matching circuit, and terminal electrodes defined thereon.

However, in the isolator disclosed in Patent Document 1, the ferrite having the center electrodes mounted thereon is substantially square-shaped, and is disposed vertically upright on the laminated substrate, which makes it difficult to provide an isolator having a low-profile design. In the isolator disclosed in Patent Document 2, the ferrite and a permanent magnet are vertically laminated on the laminated substrate, such that the permanent magnet requires a certain thickness, thus again making it difficult to provide an isolator having a low-profile design.

Although there is a demand for a low-insertion-loss isolator, the square-shaped or round-shaped ferrite disclosed in Patent Documents 1 and 2 makes it difficult to reduce the insertion loss in a wide band.

SUMMARY OF THE INVENTION

To overcome the problems described above, preferred embodiments of the present invention provide a two-port isolator and a communication apparatus which reduces the insertion loss in a wide band and achieves a low-profile design.

A two-port isolator according to a preferred embodiment of the present invention includes a permanent magnet, a ferrite to which a direct-current magnetic field is applied by the permanent magnet, a first center electrode disposed on the ferrite, the center electrode having one end electrically connected to a first input/output port and the other end electrically connected to a second input/output port, a second center electrode disposed on the ferrite so as to cross the first center electrode in an electrically isolated manner, the second center electrode having one end electrically connected to the second input/output port and the other end electrically connected to a third port as a ground, a first capacitor electrically connected between the first input/output port and the second input/output port, a termination resistor electrically connected between the first input/output port and the second input/output port, a second capacitor electrically connected between the second input/output port and the third port, and a circuit board having the first and second capacitors and the termination resistor, wherein the ferrite is substantially rectangular-parallelepiped-shaped having a first principal surface and a second principal surface that are substantially parallel to each other, the long-side dimension of the first principal surface and the second principal surface being about 1.5 to about 5 times the short-side dimension, the first and second principal surfaces being substantially vertically disposed on the circuit board. The permanent magnet is disposed on the circuit board so as to apply a magnetic field to the first and second principal surfaces of the ferrite substantially vertically to the principal surfaces. The second center electrode is wound one to four turns around the ferrite.

The number of turns of a center electrode is determined assuming that about 0.5 turns are counted each time the center electrode traverses the first or second principal surface.

The ferrite is preferably substantially rectangular-parallelepiped-shaped having a first principal surface and a second principal surface that are substantially parallel to each other, the first principal surface and the second principal surface have a long-to-short-side-dimension ratio of about 1.5:1 to about 5:1, and the second center electrode is wound one to four turns around the ferrite. Thus, as is apparent from the experimental results below, an insertion loss of about 0.5 dB or less is obtained over a wide band. That is, by winding the first and second center electrodes around the ferrite, the number of intersections of the center electrodes increases and the coupling coefficient between the first and second center electrodes is increased, resulting in low insertion loss and a wide transmission-frequency band.

Furthermore, the ferrite is configured such that the first and second principal surfaces are substantially vertically disposed on the circuit board, and the permanent magnet is disposed on the circuit board so as to apply a magnetic field to the first and second principal surfaces of the ferrite substantially vertically to the principal surfaces. In other words, the ferrite and the permanent magnet are disposed vertically upright on the circuit board. Thus, even though the thickness of the permanent magnet is increased in order to obtain a large magnetic field, the two-port isolator does not increase in height regardless of the thickness, thus achieving a low-profile design.

In the two-port isolator according to preferred embodiments of the present invention, a matching capacitor may be further electrically connected between a node of the first center electrode and the first capacitor and the first input/output port and/or between a node of the first and second center electrodes and the second input/output port. Even if the inductance of the center electrodes is increased to improve the electrical characteristics in a wide band, impedance matching to an apparatus connected to the isolator can be achieved.

Furthermore, a matching inductor may be electrically connected between a node of the second center electrode and the second capacitor and the third port. Any high-frequency wave such as the second harmonic or the third harmonic can be suppressed. Alternatively, a series circuit defined by an inductor and a capacitor may be electrically connected between the first input/output port and the ground or between the second input/output port and the ground. Also in this case, any high-frequency wave such as the second harmonic or the third harmonic can be suppressed.

In the two-port isolator according to preferred embodiments of the present invention, preferably, the ferrite has a thickness that is about 15% to about 30% of the height of the ferrite. The thickness of the ferrite that is about 15% or more of the height ensures the stable placement on the circuit board. A thickness of about 30% or more results in narrow-band electrical characteristics and insertion-loss degradation.

The second center electrode may be wound on the first and second principal surfaces of the ferrite and both side surfaces adjoining the long sides of the principal surfaces. This enables a magnetic flux produced by a current flowing in the second center electrode to be generated substantially in parallel to the ground surface, and prevents the flow of a high-frequency magnetic flux passing in the ferrite from being blocked by the ground surface. In the two-port isolator according to preferred embodiments of the present invention, since the proportion of the high-frequency current flowing in the second center electrode is greater than that in the first center electrode, such a structure provides a high coupling coefficient between the first and second center electrodes, resulting in wide-band electrical characteristics. In addition, the second center electrode has a high inductance and a high Q factor with low insertion loss. Furthermore, the isolator has a broad operating bandwidth.

Preferably, a connection electrode of the first center electrode that is defined on an end surface adjoining the short sides of the first and second principal surfaces of the ferrite has an area that is about 25% or less of the area of the end surface. This setting results in less blocking of the high-frequency magnetic flux passing in the ferrite, thus preventing narrow-band electrical characteristics without reducing the coupling coefficient between the first and second center electrodes. For a similar reason, the area of a connection electrode defined on one side surface adjoining the long sides of the first and second principal surfaces of the ferrite is preferably about 25% or less of the area of the principal surfaces of the ferrite.

Most preferably, both end surfaces adjoining the short sides of the first and second principal surfaces of the ferrite do not include the first and second center electrodes and connection electrodes, which is effective to reduce the insertion loss or improve the operating bandwidth of the isolator. That is, the high-frequency magnetic flux produced in the ferrite is not restricted because there is no conductor on the end surfaces. The center electrodes, in particular, the second center electrode, have a high inductance, resulting in a high Q factor and a low insertion loss. Since passing of the high-frequency magnetic flux is not blocked, the coupling coefficient between the first and second center electrodes is not reduced and the operating bandwidth is also improved.

Preferably, connection electrodes of the first and second center electrodes are disposed on one side surface adjoining the long sides of the first and second principal surfaces of the ferrite. The connection electrodes are formed together on one side surface, thereby providing higher working efficiency in the manufacturing process or the assembling process and improved connection with the circuit board.

The winding axis of the second center electrode may be located in a plane that is substantially perpendicular to the short sides of the first and second principal surfaces of the ferrite. Since the direction of the high-frequency magnetic field produced is horizontal to the circuit board surface, the coupling coefficient between the first and second center electrodes is high, and wide-band electrical characteristics are obtained. Further, the winding axis of the second center electrode may be located in a direction that is substantially perpendicular to the magnetic field applied from the permanent magnet. Also in this case, the direction of the high-frequency magnetic field produced is horizontal to the circuit board surface, resulting in high electrical characteristics.

Furthermore, in the two-port isolator according to preferred embodiments the present invention, the first and second center electrodes may be film-like electrodes, metal-foil electrodes, or metal-plate electrodes defined on the ferrite. Alternatively, the first and second center electrodes may be formed by printing, transferring, or forming by photolithography a thick film, thin film, or foil on the ferrite. Preferably, the thick film, thin film, or foil includes at least one of silver, copper, gold, nickel, platinum, and palladium.

A communication apparatus according to another preferred embodiment of the present invention includes the two-port isolator. The insertion loss is improved in a wide band, and a low-profile design of the apparatus is achieved.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

A two-port isolator and a communication apparatus according to preferred embodiments of the present invention will be described with reference to the drawings.

Figure 1:
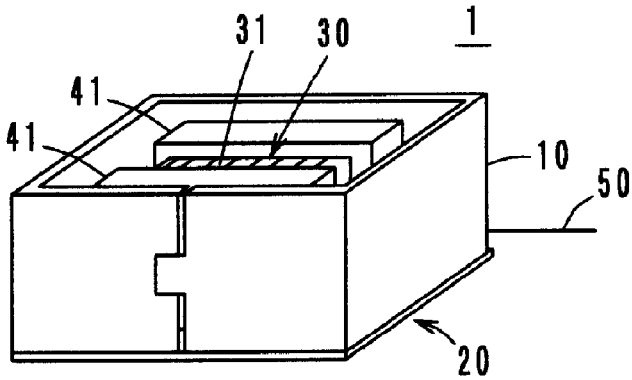
FIG. 1 is a perspective view showing a two-port isolator according to a preferred embodiment of the present invention.
Figure 2:
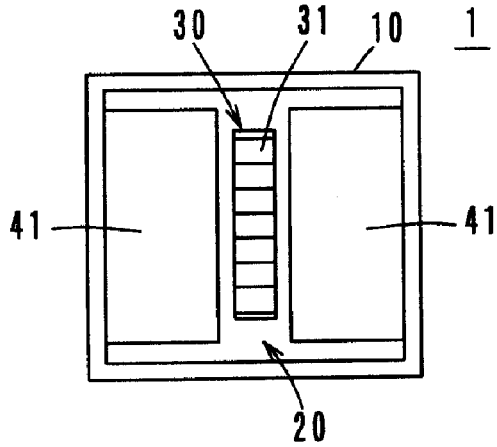
FIG. 2 is a plan view showing the two-port isolator.
Figure 3:
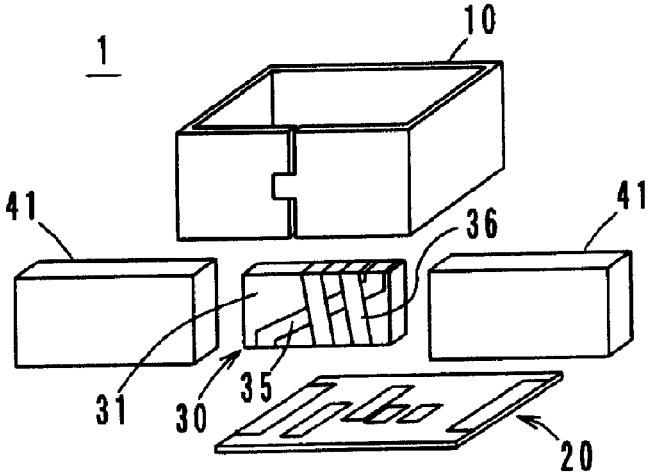
FIG. 3 is an exploded perspective view of the two-port isolator.

FIGS. 1, 2, and 3 are an external view, a plan view, and an exploded perspective view of a two-port isolator according to a preferred embodiment of the present invention, respectively. A two-port isolator 1 is preferably a lumped-constant isolator, and substantially includes a metal yoke 10, a circuit board 20, a center-electrode assembly 30 including a ferrite 31, and permanent magnets 41 for applying a direct-current magnetic field to the ferrite 31. FIG. 1 shows a state in which the isolator 1 is mounted on a substrate 50.

The yoke 10 is made of a ferromagnetic material, such as soft iron, and is plated with silver. The yoke 10 is frame-shaped so as to enclose the center-electrode assembly 30 and the permanent magnets 41 on the circuit board 20.

Figure 4:
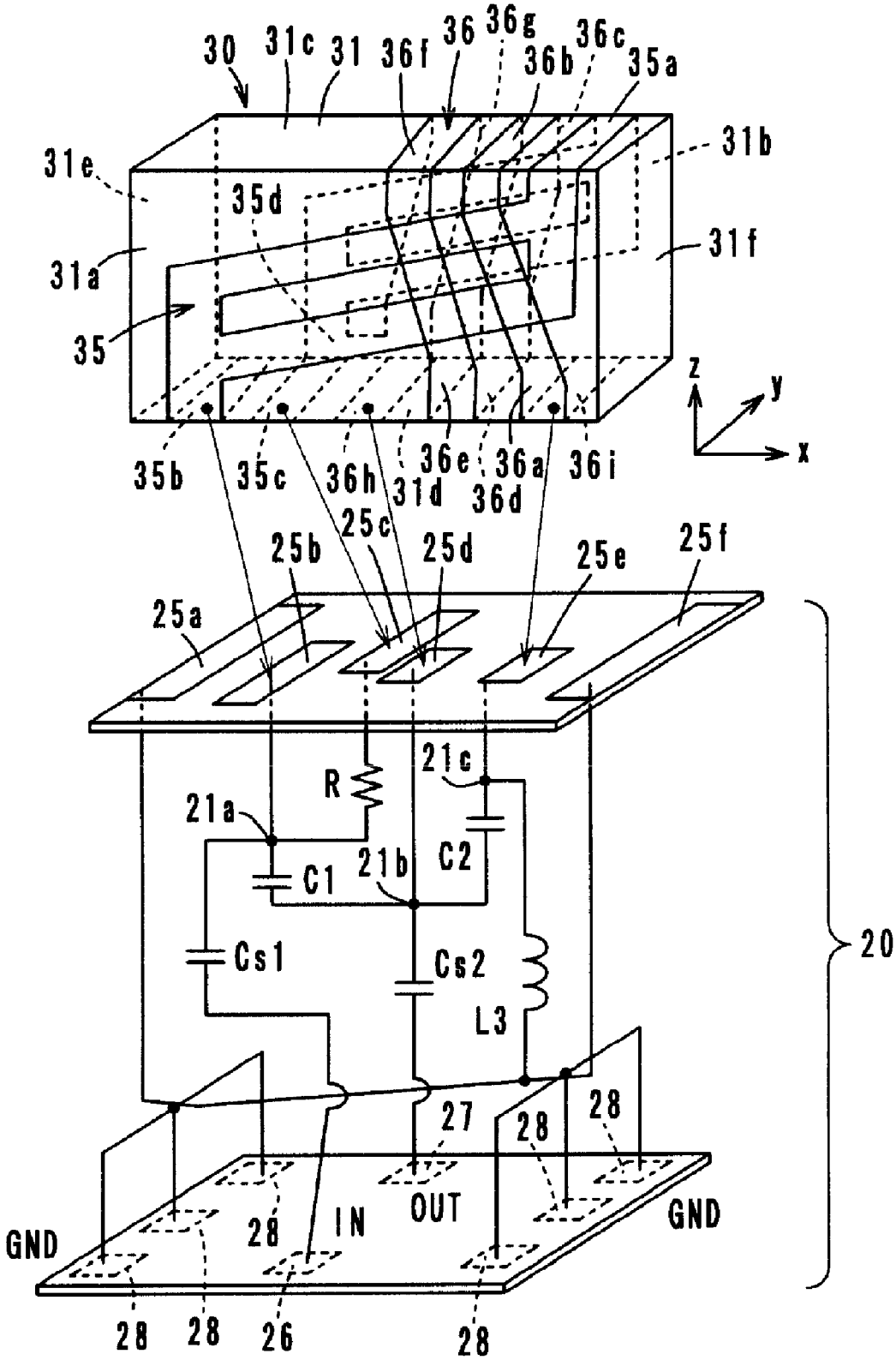
FIG. 4 is an exploded perspective view showing the main part of the two-port isolator.

As shown in FIG. 4, the center-electrode assembly 30 is configured such that a first center electrode 35 and a second center electrode 36 that are electrically isolated from each other are defined on principal surfaces 31*a* and 31*b* of a microwave ferrite 31. The ferrite 31 is preferably substantially rectangular-parallelepiped-shaped including the first principal surface 31*a* and the second principal surface 31*b* that are substantially parallel to each other. The first principal surface 31*a* and the second principal surface 31*b* have a short-to-long-side-length ratio (hereinafter referred to as a "shape ratio") of about 1:1.5 to about 1:5, and the first principal surface 31*a* and the second principal surface 31*b* are substantially vertically disposed on the circuit board 20. The surfaces adjoining the long sides of the principal surfaces 31*a* and 31*b* are referred to as side surfaces 31*c* and 31*d*, and the surfaces adjoining the short sides are referred to as end surfaces 31*e* and 31*f*.

The permanent magnets 41 are disposed on the circuit board 20 so as to apply a magnetic field substantially vertically to the principal surfaces 31*a* and 31*b* of the ferrite 31.

As shown in FIG. 4, the first center electrode 35 is defined so as to be separated into two parts on the first principal surface 31*a* of the ferrite 31 and to be inclined from the lower left to the upper right at a relatively small angle with respect to the long sides. The first center electrode 35 wraps around the second principal surface 31*b* through a connection electrode 35*a* defined on the side surface 31*c*, and is defined so as to be separated into two parts on the second principal surface 31*b* and to be inclined to the lower left at a relatively small angle with respect to the long sides.

First, a 0.5th turn 36*a* of the second center electrode 36 is arranged so as to be inclined from the lower right to the upper left on the first principal surface 31*a* at a relatively large angle with respect to the long sides and to cross the first center electrode 35. The second center electrode 36 wraps around the second principal surface 31*b* through a connection electrode 36*b* defined on the side surface 31*c*. A first turn 36*c* of the second center electrode 36 is defined so as to be inclined to the left on the second principal surface 31*b* at a relatively large angle with respect to the long sides and to cross the first center electrode 35. The lower end of the first turn 36*c* wraps around the first principal surface 31*a* through a connection electrode 36*d* defined on the side surface 31*d*. A 1.5th turn 36*e* of the second center electrode 36 is arranged substantially parallel to the 0.5th turn 36*a* on the first principal surface 31*a* so as to cross the first center electrode 35, and wraps around the second principal surface 31*b* through a connection electrode 36*f* defined on the side surface 31*c*. A second turn 36*g* of the second center electrode 36 is also arranged substantially parallel to the first turn 36*c* on the second principal surface 31*b* so as to cross the first center electrode 35, and is connected to a connection electrode 36*h* defined on the side surface 31*d*.

The second turn 36*g* of the second center electrode 36 is also connected to the other end of the first center electrode 35 on the second principal surface 31*b*.

That is, the second center electrode 36 is spirally wound about two turns around the ferrite 31. The number of turns is determined assuming that 0.5 turns are counted each time the center electrode 36 traverses the first or second principal surface 31*a* or 31*b*. The crossing angle of the center electrodes 35 and 36 is defined, as required, to adjust the input impedance and the insertion loss.

The circuit board 20 is a laminate-type substrate that is produced by laminating and sintering a plurality of dielectric sheets having predetermined electrodes provided thereon, and has built therein, as shown in FIG. 4, matching capacitors C1, C2, Cs1, and Cs2, a matching inductor L3, and a termination resistor R. The circuit board 20 further includes terminal electrodes 25*a* to 25*f* provided on the top surface thereof, and external-connection terminal electrodes 26, 27, and 28 provided on the bottom surface thereof.

Figure 5:
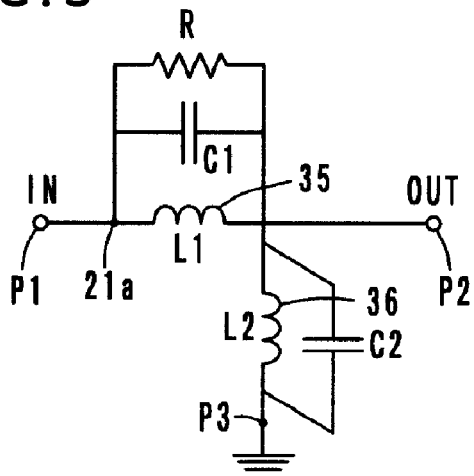
FIG. 5 is an equivalent circuit diagram showing a first example circuit of the two-port isolator.
Figure 6:
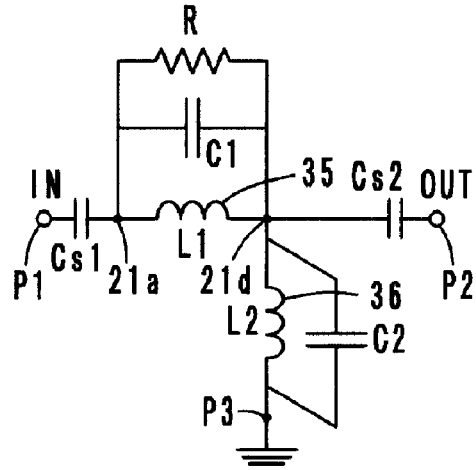
FIG. 6 is an equivalent circuit diagram showing a second example circuit of the two-port isolator.
Figure 7:
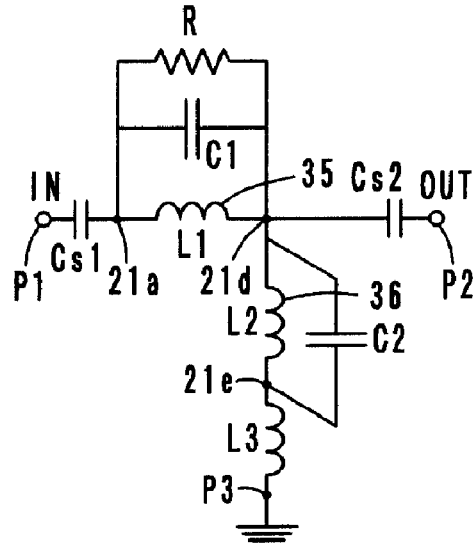
FIG. 7 is an equivalent circuit diagram showing a third example circuit of the two-port isolator.

The connection relationship between those matching circuit devices and the first and second center electrodes 35 and 36 will be described with reference to FIG. 4 and equivalent circuits shown in FIGS. 5, 6, and 7. The equivalent circuit shown in FIG. 5 represents a first example circuit, which is basic in the two-port isolator 1 according to preferred embodiments the present invention; the equivalent circuit shown in FIG. 6 represents a second example circuit; and the equivalent circuit shown in FIG. 7 represents a third example circuit. In FIG. 4, the structure of the third example circuit shown in FIG. 7 is illustrated.

That is, the external-connection terminal electrode 26 provided on the bottom surface of the circuit board 20 functions as an input port P1, and the electrode 26 is connected to a node 21*a* of the matching capacitor C1 and the termination resistor R via the matching capacitor Cs1. The node 21*a* is further connected to one end of the first center electrode 35 via the terminal electrode 25*b* provided on the top surface of the circuit board 20 and a connection electrode 35*b* provided on the side surface 31*d* of the ferrite 31.

The other end of the first center electrode 35 is connected to the termination resistor R via a connection electrode 35*c* provided on the side surface 31*d* of the ferrite 31 and the terminal electrode 25*c* provided on the top surface of the circuit board 20. The other end 35*d* of the first center electrode 35 is further connected to a node 21*b* of the matching capacitors C1, C2, and Cs2 via the connection electrode 36*h* provided on the side surface 31*d* of the ferrite 31 and the terminal electrode 25*d* provided on the top surface of the circuit board 20.

On the other hand, the external-connection terminal electrode 27 provided on the bottom surface of the circuit board 20 functions as an output port P2, and the electrode 27 is connected to the node 21*b* via the matching capacitor Cs2.

An electrode 36*i* for connection to one end of the second center electrode 36 (which is defined on the side surface 31*d* of the ferrite 31) is connected to a node 21*c* of the matching capacitor C2 and the matching inductor L3 via the terminal electrode 25*e* provided on the top surface of the circuit board 20. The other end of the matching inductor L3 is connected to the external-connection terminal electrodes 28 provided on the bottom surface of the circuit board 20. The external-connection electrodes 28 function as ground ports P3. The external-connection electrodes 28 are also connected to the yoke 10 via the terminal electrodes 25*a* and 25*f* provided on the top surface of the circuit board 20.

The circuit board 20 and the yoke 10 are soldered through the terminal electrodes 25*a* and 25*f* and are integrated. The center electrode assembly 30 is formed by soldering the individual connection electrodes provided on the side surface 31*d* of the ferrite 31 so as to be integrated with the terminal electrodes 25*b* to 25*e* on the circuit board 20. Further, the permanent magnets 41 are integrated with the inner wall of the yoke 10 by an adhesive or other suitable connection material or elements.

In the two-port isolator 1 having the above-described structure, the ferrite 31 preferably has a substantially rectangular-parallelepiped-shaped having the first principal surface 31*a* and the second principal surface 31*b* that are substantially parallel to each other. The first principal surface 31*a* and the second principal surface 31*b* have a short-to-long-side-length ratio (shape ratio) of an appropriate value as described in detail below. Further, the second center electrode 36 is wound about two turns around the ferrite 31. Thus, as is apparent from the measurement results described in detail below, an insertion loss of about 0.5 dB or less is obtained over a wide band. This means that by winding the first and second center electrodes 35 and 36 around the ferrite 31, the number of intersections of the center electrodes 35 and 36 increases and the coupling coefficient between the center electrodes 35 and 36 increases, resulting in a low insertion loss and a wide transmission-frequency band.

The ferrite 31 is configured such that the principal surfaces 31*a* and 31*b* are substantially vertically disposed on the circuit board 20, and the permanent magnets 41 are disposed on the circuit board 20 so as to apply a magnetic field to the principal surfaces 31*a* and 31*b* of the ferrite 31 substantially vertically to the principal surfaces 31*a* and 31*b*. In other words, the ferrite 31 and the permanent magnets 41 are disposed vertically upright on the circuit board 20. Thus, even though the thickness of the permanent magnets 41 is increased in order to obtain a large magnetic field, the two-port isolator 1 does not increase in height regardless of the thickness, thus achieving a low-profile design.

Further, as shown in the second example circuit (see FIG. 6), the matching capacitors Cs1 and Cs2 are further inserted between the node 21*a* of the first center electrode 35 and the capacitor C1 and the input port P1 and between a node 21*d* of the center electrodes 35 and 36 and the output port P2, respectively. Thus, even if the inductance of the center electrodes 35 and 36 is increased to improve the electrical characteristics in a wide band, impedance (about 50Ω) matching to an apparatus connected to the isolator is accomplished. This advantage is also achieved by inserting either of the matching capacitors Cs1 or Cs2.

Figure 8:
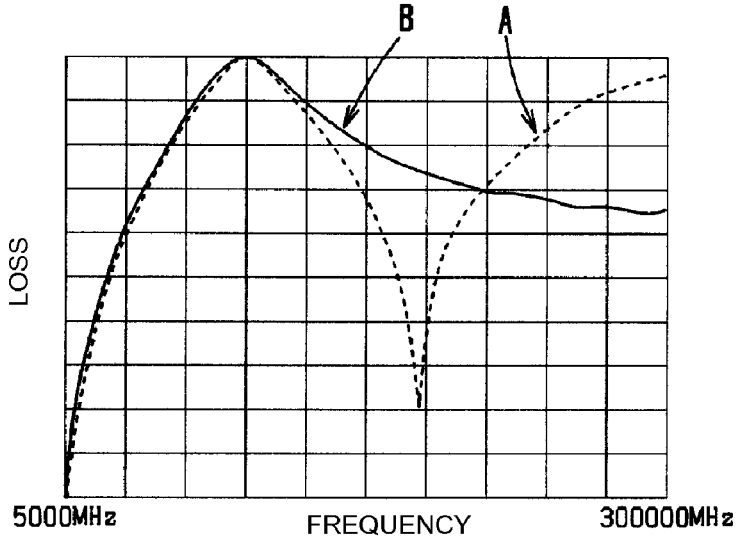
FIG. 8 is a graph showing a high-frequency waveform using the third example circuit.

Further, as shown in the third example circuit (see FIG. 7), the matching inductor L3 is inserted between a node 21*e* of the second center electrode 36 and the capacitor C2 and the ground port P3, thus suppressing any high-frequency wave, such as the second harmonic or the third harmonic. A curve A shown in FIG. 8 represents a high-frequency waveform when the matching inductor L3 is inserted in series. In FIG. 8, a curve B represents a waveform when the inductor L3 is not inserted.

Figure 9A:
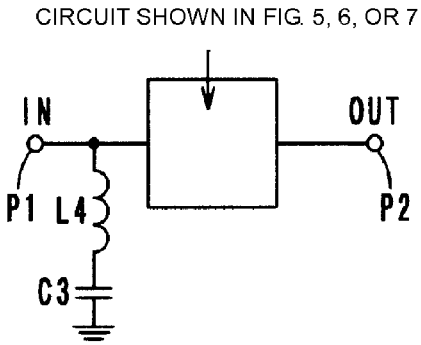
FIGS. 9A and 9B are equivalent circuit diagrams showing a fourth example circuit of the two-port isolator.
Figure 9B:
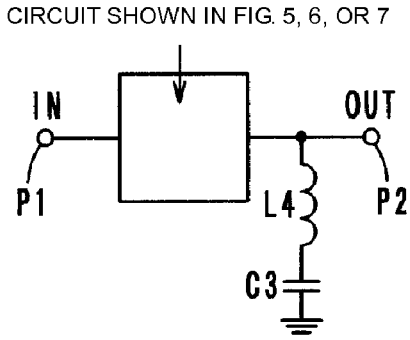
Figure 10:
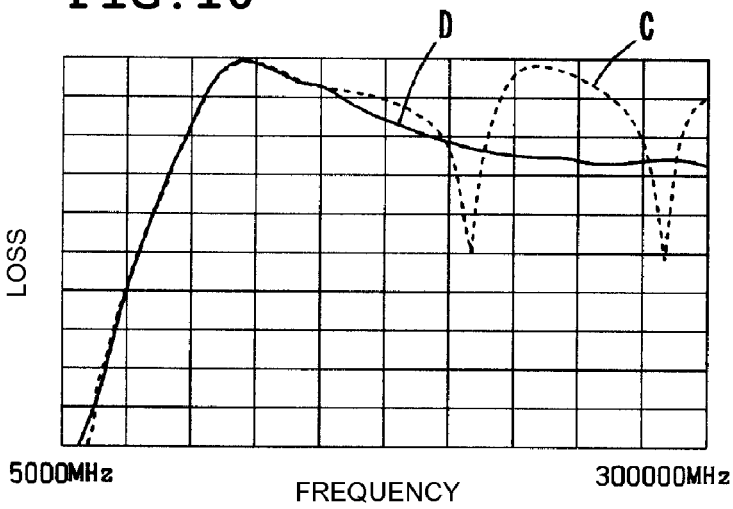
FIG. 10 is a graph showing a high-frequency waveform using the fourth example circuit.

As shown in fourth example circuits shown in FIGS. 9A and 9B, an LC series circuit defined an inductor L4 and a capacitor C3 may be inserted between the input port P1 and the ground or between the output port P2 and the ground. Such an LC series circuit suppresses any high-frequency wave, such as the second harmonic or the third harmonic. A curve C shown in FIG. 10 represents a high-frequency waveform when such an LC series circuit and the inductor L3 are inserted. In FIG. 10, a curve D represents a waveform when the LC series circuit and the inductor L3 are not inserted.

Figure 11:
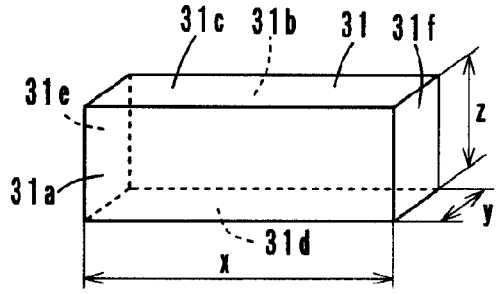
FIG. 11 is a perspective view showing the shape of a ferrite.
Figure 12:
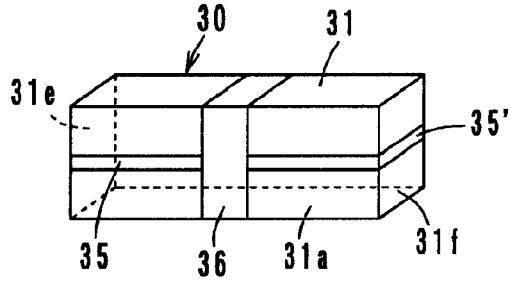
FIG. 12 is a perspective view showing an example of the winding form of center electrodes.
Figure 13:
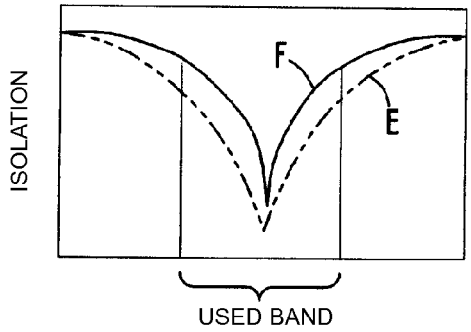
FIG. 13 is a graph showing isolation in the winding form shown in FIG. 12.

In the substantially rectangular-parallelepiped-shaped ferrite 31, as shown in FIG. 11, if the long-side length of the principal surfaces 31*a* and 31*b* is represented by x, the height is represented by z, and the thickness is represented by y, it is necessary to satisfy x>y. By configuring the ferrite 31 so as to be elongated in one direction x, the length of the lines of the center electrodes 35 and 36 can be increased while maintaining the low-profile design of the isolator 1. When the crossing angle of the center electrodes 35 and 36 is maintained at a desired value and the length of the line of the first center electrode 35 is increased (as shown in FIG. 12, when the first center electrode 35 is defined along the long-side direction x of the ferrite 31), as shown in FIG. 13, wide-band isolation is achieved. In FIG. 13, a curve E represents a case where the line of the first center electrode 35 is relatively long, and a curve F represents a case where the line of the first center electrode 35 is relatively short.

The thickness y of the ferrite 31 is preferably about 15% to about 30% of the height z. If the thickness y of the ferrite 31 is less than about 15% of the height z, the area of the side surface 31*d* is small to cause significant instability if the principal surfaces 31*a* and 31*b* of the ferrite 31 are mounted vertically to the circuit board 20. A thickness of about 15% or more ensures the stable placement on the circuit board 20. In excess of about 30%, however, the uniformity of the direct-current magnetic field at both ends and the center in the long-side direction x of the ferrite 31 is deteriorated. This results in narrow-band electrical characteristics and insertion-loss degradation.

Figure 14:
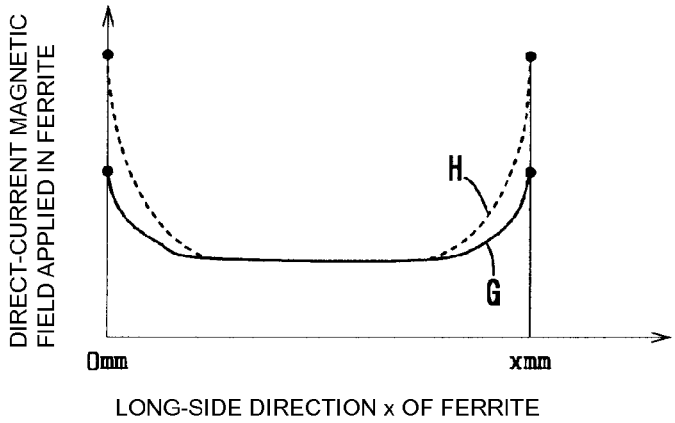
FIG. 14 is a graph showing a direct-current magnetic field in the long-side direction of the ferrite.

FIG. 14 shows a direct-current magnetic field applied in the ferrite 31 along the long-side direction x. A curve G represents a case where z:y is about 100:30 or less, and a curve H represents a case where z:y is more than about 100:30.

In the isolator 1 of the present preferred embodiment, the first and second center electrodes 35 and 36 are wound at least one turn around the ferrite 31. Thus, the number of intersections of the center electrodes 35 and 36 are increased, and the coupling coefficient between the center electrodes 35 and 36 is increased, thus achieving a wider band.

Figure 15:
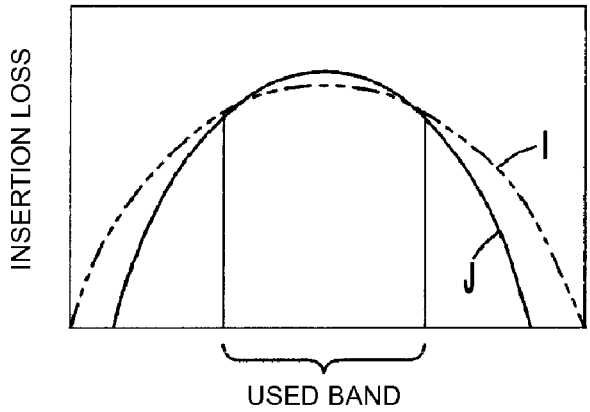
FIG. 15 is a graph showing the insertion loss caused by increasing the number of turns of a second center electrode.

The line length of the center electrodes 35 and 36 can be increased by increasing the number of turns. By increasing the number of turns of the first center electrode 35, wide-band isolation is achieved (see FIG. 13). By increasing the number of turns of the second center electrode 36, as shown in FIG. 15, the insertion loss is reduced over a wide band. In FIG. 15, a curve I represents a case where the line of the second center electrode 36 is relatively long, and a curve J represents a case where the line of the second center electrode 36 is relatively short.

Further, by winding the first and second center electrodes 35 and 36 at least one turn, a larger area of the principal surfaces 31*a* and 31*b* of the ferrite 31 can be covered by the center electrodes 35 and 36. Thus, a uniform distribution of the high-frequency magnetic flux passing in the ferrite 31 is achieved, and wider-band insertion-loss characteristics are obtained. The inductances L1 and L2 of the center electrodes 35 and 36 are approximately in proportion to the square of the number of turns. The Q factor of the inductance is given by $\omega L/R$. Since L is in direct proportion to $N^2$ (where N denotes the number of turns), the Q factor of the center electrodes 35 and 36 can be increased by winding the center electrodes 35 and 36. As a result, the input loss of isolation can be reduced. The higher the inductances L1 and L2 are, the wider the band of isolation is.

On the other hand, a structure in which the center electrodes 35 and 36 is wound 0.5 turns around the ferrite 31 makes it difficult to join the side surface 31*d* of the ferrite 31 to the circuit board 20 to be bonded thereto. This difficulty is overcome by winding the center electrodes 35 and 36 at least one turn.

Figure 16A:
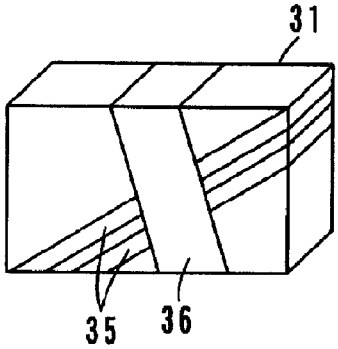
FIGS. 16A-16C are perspective views showing other examples of the winding configuration of the center electrodes.
Figure 16B:
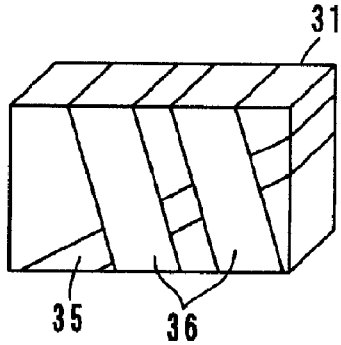
Figure 16C:
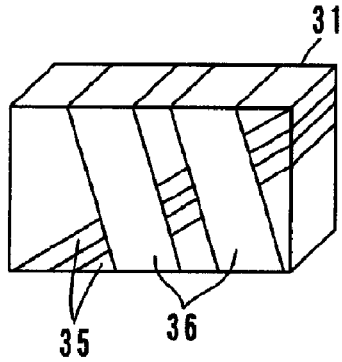

While a preferred configuration for winding the center electrodes 35 and 36 at least one turn around the ferrite 31 is shown in FIG. 4, other alternative winding configurations shown in FIGS. 16A, 16B, and 16C may be used. It is to be noted that still other winding configurations are also available.

In the two-port isolator 1, the second center electrode 36 is wound on the first and second principal surfaces 31*a* and 31*b* and the side surfaces 31*c* and 31*d* of the ferrite 31. This means that it is wound on the first principal surface 31*a*, the side surface 31*c*, the second principal surface 31*b*, and the side surface 31*d* in the order stated or, conversely, it is wound on the first principal surface 31*a*, the side surface 31*d*, the second principal surface 31*b*, and the side surface 31*c* in the order stated.

Figure 17:
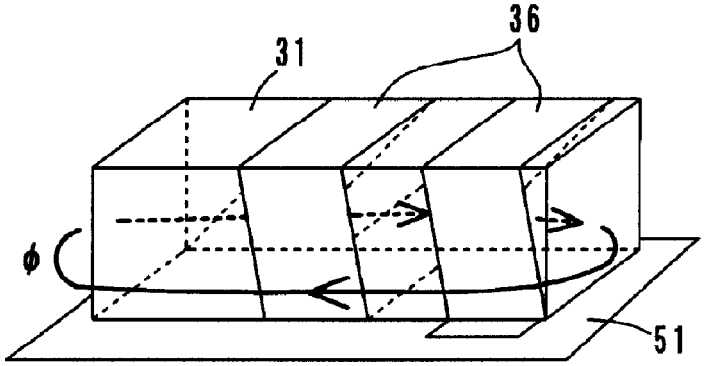
FIG. 17 is an explanatory diagram showing a high-frequency magnetic flux passing in the ferrite.

In the first, second, and third example circuits shown in FIGS. 5, 6, and 7, it is found from a measurement or simulation of the high-frequency magnetic flux that the proportion of the high-frequency current flowing in the second center electrode 36 is greater than that in the first center electrode 35. Therefore, it is more effective to wind the second center electrode 36 along the four surfaces that are substantially parallel to the long sides of the ferrite 31 because the magnetic flux produced by the current flowing in the second center electrode 36 is substantially parallel to a mounting surface 51 on which electrodes, such as ground electrodes and capacitor electrodes, are provided (see FIG. 17, which means the substrate 50 (see FIG. 1) prepared by a user or the ground terminal electrodes 25*a* and 25*f* defined on the circuit board 20), thus preventing the flow of a high-frequency magnetic flux $\phi$ passing in the ferrite 31 from being blocked by the ground surface 51.

Such a structure provides a high coupling coefficient between the center electrodes 35 and 36, resulting in wide-band electrical characteristics. Since the flow of the magnetic flux is not blocked by the mounting surface 51, the inductance L2 of the second center electrode 36 is high, resulting in a high Q factor and a low insertion loss. Moreover, the isolator has a broad operating bandwidth.

As shown in FIG. 12, when a connection electrode 35' of the first center electrode 35 is defined on the end surfaces 31*e* and 31*f* of the ferrite 31, the area of the connection electrode 35' is preferably about 25% or less of the area of each of the end surfaces 31*e* and 31*f*. If the area of the connection electrode 35' provided on the end surfaces 31*e* and 31*f* of the ferrite 31 is more than about 25% of that of the end surfaces 31*e* and 31*f*, the flow of the high-frequency magnetic flux passing in the ferrite 31 is blocked by the connection electrode 35', and the coupling coefficient of the center electrodes 35 and 36 is decreased. An area of about 25% or less results in less blocking of the high-frequency magnetic flux passing in the ferrite 31, thus preventing narrow-band electrical characteristics without reducing the coupling coefficient between the center electrodes 35 and 36.

Most preferably, the end surfaces 31*e* and 31*f* of the ferrite 31 do not include the center electrodes 35 and 36 and connection electrodes thereof, which is effective to reduce the insertion loss, and thus, improve the operating bandwidth of the isolator. That is, the high-frequency magnetic flux produced in the ferrite 31 is not restricted because there is no conductor on the end surfaces 31*e* and 31*f*. In particular, the second center electrode 36 has a high inductance, resulting in a high Q factor and a low insertion loss. Since the passing of the high-frequency magnetic flux is not blocked, the coupling coefficient between the center electrodes 35 and 36 is not reduced and the operating bandwidth is improved.

For a similar reason, the area of the connection electrodes 35*a*, 36*b*, and 36*f* defined on the side surface 31*c* adjoining the long sides of the first and second principal surfaces 31*a* and 31*b* of the ferrite 31 is preferably about 25% or less of the area of each of the principal surfaces 31*a* and 31*b* of the ferrite 31.

In the two-port isolator 1, connection electrodes of the center electrodes 35 and 36 are defined on the side surfaces 31*c* and 31*d* of the ferrite 31. When the connection electrodes are formed of thick-film electrodes by using, for example, a transfer method, or by using any other suitable technique, they are formed together on the side surfaces 31*c* and 31*d* of the ferrite 31, thereby providing higher working efficiency in the manufacturing process or the assembling process and low production cost. The connection with the circuit board 20 having built-in matching circuit devices is also improved.

The winding axis of the second center electrode 36 is located in a plane that is substantially perpendicular to the principal surfaces 31*a* and 31*b* of the ferrite 31. Since the direction of the high-frequency magnetic field produced is horizontal to the surface of the circuit board 20, the coupling coefficient between the center electrodes 35 and 36 is high, and wide-band electrical characteristics are obtained.

Further, the winding axis of the second center electrode 36 is located in a direction substantially that is substantially perpendicular to the magnetic field applied from the permanent magnets 41. Also in this case, the direction of the high-frequency magnetic field produced is horizontal to the surface of the circuit board 20, resulting in high electrical characteristics.

Furthermore, in the two-port isolator 1, the center electrodes 35 and 36 may be film-like electrodes, metal-foil electrodes, or metal-plate electrodes provided on the ferrite 31. Alternatively, the center electrodes 35 and 36 may be formed by printing, transferring, or formed by photolithography a thick film, thin film, or foil on the ferrite 31. Preferably, the thick film, thin film, or foil includes at least one of silver, copper, gold, nickel, platinum, and palladium.

In particular, by forming the center electrodes 35 and 36 using a thin-film method, the center electrodes 35 and 36 can be formed with precise and stable dimensions, such as the crossing angle, the line width, and the line pitch, and a high productivity is achieved. As a result, products with stable electrical characteristics can be manufactured in high volume at low cost.

Where the center electrodes 35 and 36 are formed by screen printing, transfer, photolithography, or any other method, there are minimum dimensions allowed by such a method. The minimum dimensions are currently about 0.2 mm in line width, and about 0.2 mm in line pitch. In a design with smaller dimensions, the lines may be broken or the line width or the line pitch may not be constant, resulting in variations in inductance or distributed capacitance in the line sections and variations in equivalent series resistance.

Figure 18:
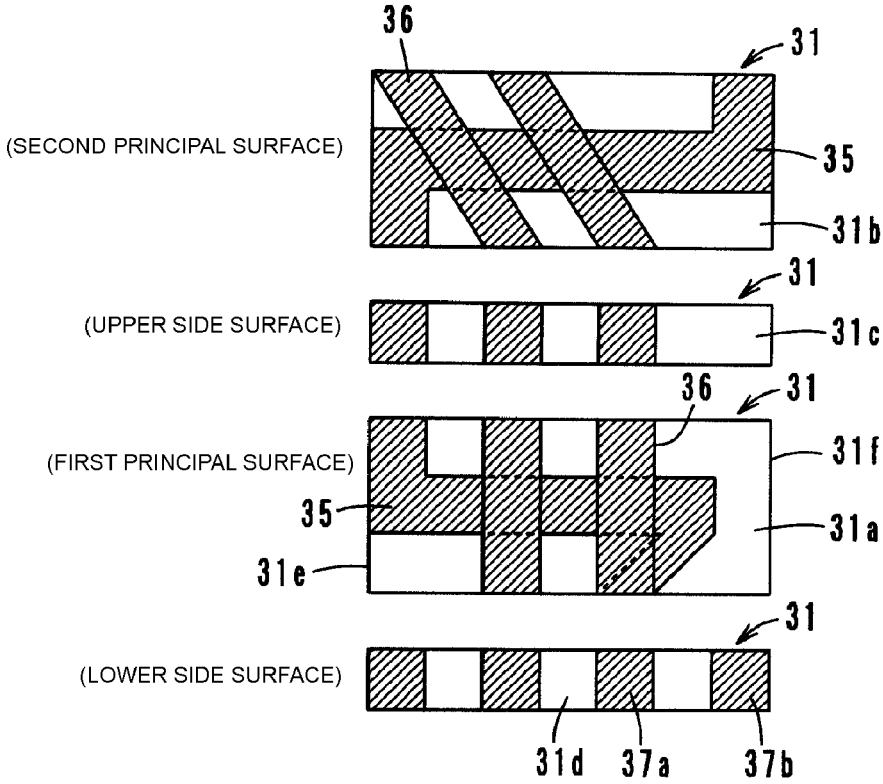
FIG. 18 is an explanatory diagram showing an example formation (first example) of the center electrodes on the respective surfaces.
Figure 19:
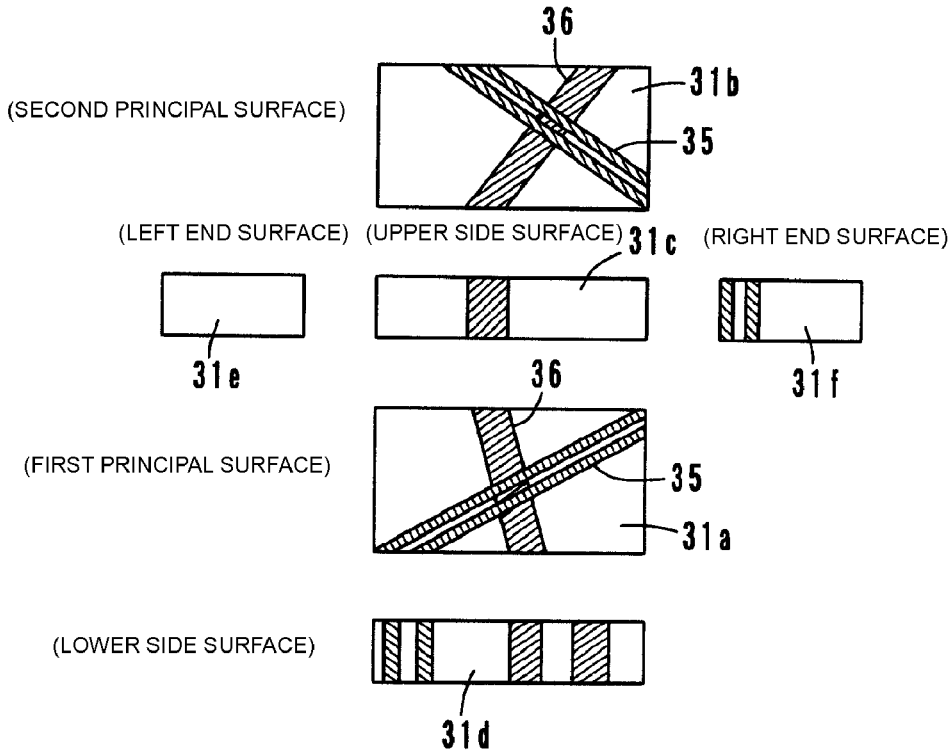
FIG. 19 is an explanatory diagram an example formation (second example) of the center electrodes on the respective surfaces.
Figure 20:
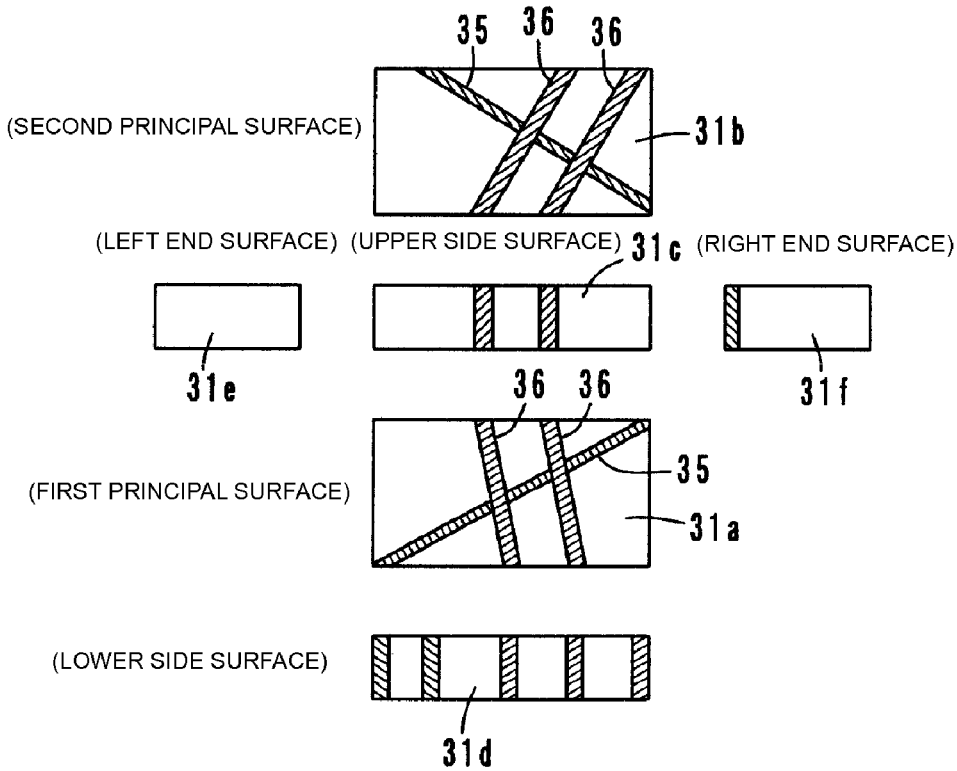
FIG. 20 is an explanatory diagram an example formation (third example) of the center electrodes on the respective surfaces.
Figure 21:
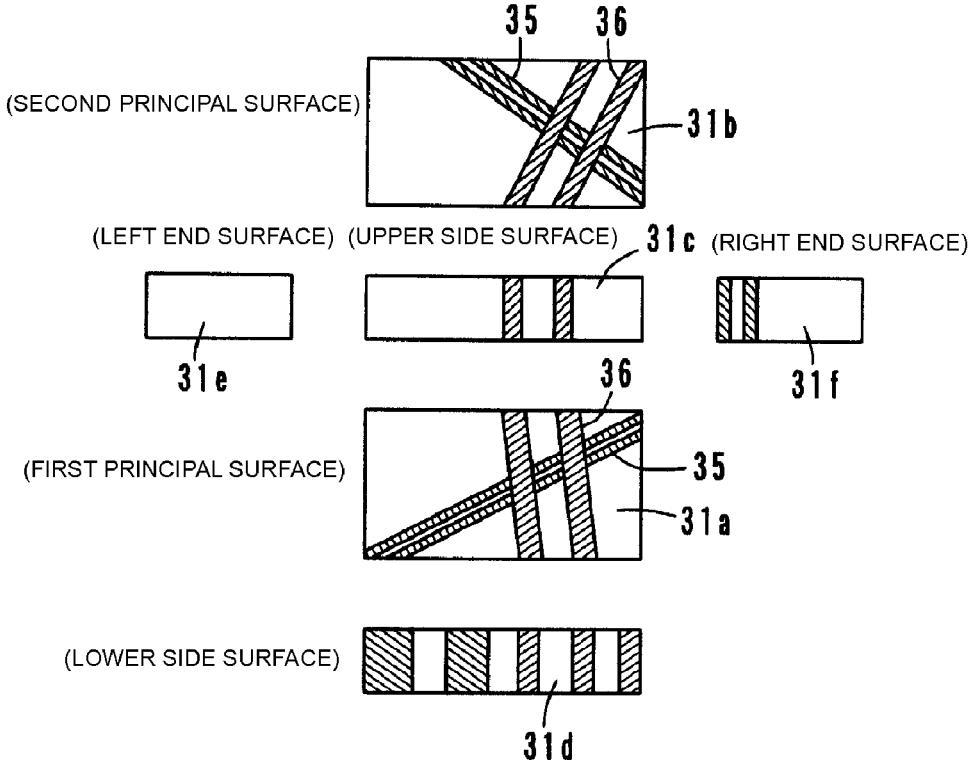
FIG. 21 is an explanatory diagram an example formation (fourth example) of the center electrodes on the respective surfaces.
Figure 22:
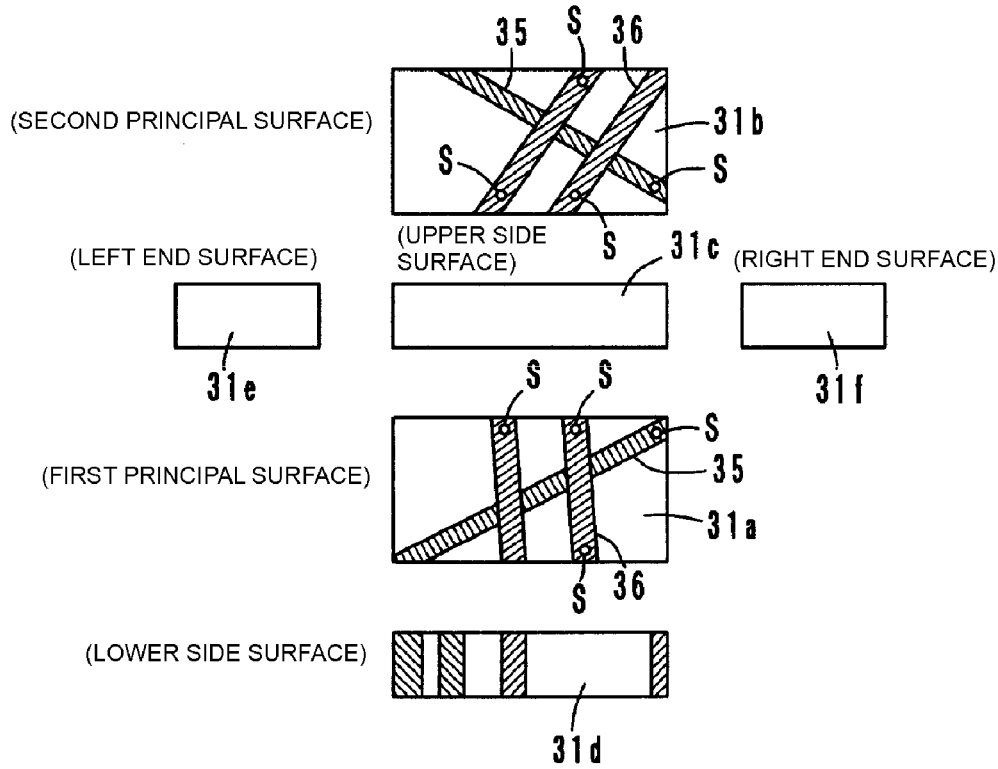
FIG. 22 is an explanatory diagram an example formation (fifth example) of the center electrodes on the respective surfaces.
Figure 23:
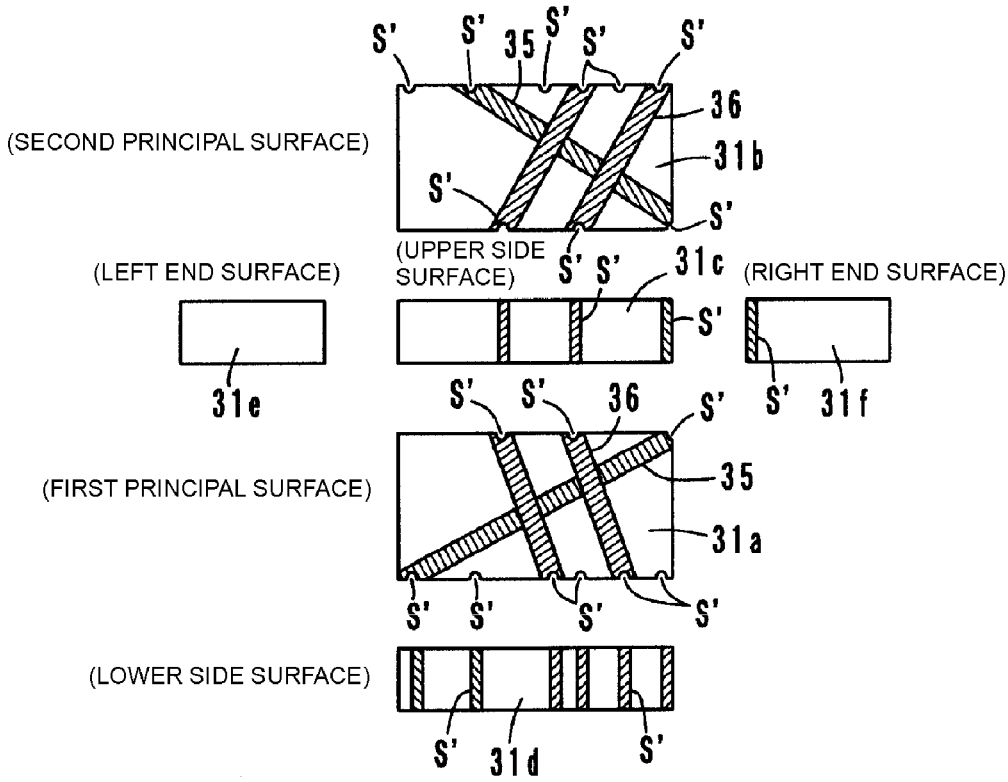
FIG. 23 is an explanatory diagram an example formation (sixth example) of the center electrodes on the respective surfaces.

FIG. 18 shows an example in which center electrodes are formed on a ferrite with a minimum line width and pitch of about 0.2 mm. Other examples of the electrode formation are shown in FIGS. 19 to 23. In FIGS. 22 and 23, the electrodes defined on the first principal surface 31*a* and the second principal surface 31*b* are connected via through-holes S and S', respectively.

In the electrode-formation examples shown in FIG. 18, if the number of turns of the second center electrode 36 is two, the electrode length is about twice that of one turn. The equivalent series resistance Rs of the second center electrode 36 is therefore about twice that of one turn. The inductance, on the other hand, increases with the square of the number of turns due to self-induction, and is therefore about four times that of one turn. The Q factor of the second center electrode 36 is calculated by $Q=X/Rs=\omega L/Rs$ (where X denotes the reactance of the inductor and $\omega$ denotes the frequency). The Q factor of the second center electrode 36 is therefore about two times that of one turn. In forward power transmission, a resonance current flows in the second center electrode 36. The Q factor is an element that determines the insertion loss, and a high Q factor leads to a low insertion loss.

Since the inductance of the second center electrode 36 is about four times that of one turn, the isolator provides wide-band output matching, resulting in a broad operating frequency bandwidth of the output-side return loss or insertion loss. In the electrode-formation example shown in FIG. 18, an electrode 37*a* is commonly used as an electrode for connection to the other end of the first center electrode 35 and an electrode for connection to the other end of the second center electrode 36, and the first and second center electrodes 35 and 36 are provided on the ferrite 31 with the minimum dimensions allowed. The ferrite 31 has a long-side length of about 1.4 mm, a height of about 0.6 mm, and a thickness of about 0.2 mm, and the principal surfaces 31*a* and 31*b* have a long-to-short-side-length ratio of about 2.333:1.

In order to obtain the preferred center-electrode shape, it is necessary to provide at least three lines and two spaces in the long-side direction of the principal surfaces 31*a* and 31*b* of the ferrite 31 when the second center electrode 36 is wound one turn. It is also necessary to provide at least one line and two spaces in the short-side direction of the principal surfaces 31*a* and 31*b* of the ferrite 31. In this case, when the preferred center-electrode shape is obtained using the ferrite 31 with the minimum dimensions, the principal surfaces of the ferrite have a long-to-short-side-length ratio of about 2:1 to about 3:1.

When the second center electrode 36 is wound two turns, it is necessary to provide at least four lines and three spaces in the long-side direction of the principal surfaces 31*a* and 31*b* of the ferrite 31. It is also necessary to provide at least one line and two spaces in the short-side direction of the principal surfaces 31*a* and 31*b* of the ferrite 31. In this case, when the preferred center-electrode shape is obtained using the ferrite 31 with the minimum dimensions, the principal surfaces 31*a* and 31*b* of the ferrite 31 have a long-to-short-side-length ratio of about 2.333:1.0.

When the second center electrode 36 is wound three or more turns, a lower-loss wider-band isolator is achieved, or an isolator having a ferrite with a smaller size while ensuring necessary performance is achieved. In this case, the long-to-short-side-length ratio of the principal surfaces 31*a* and 31*b* of the ferrite 31 is larger. Due to the complexity of the center-electrode structure, an electrode-formation technique with high accuracy and high stability is therefore required.

Assuming that the side surface 31*d* of the ferrite 31 is bonded onto the circuit board 20, the low-profile design of the isolator is facilitated as the height of the ferrite 31 is reduced. Also, it is required that the long sides of the ferrite 31 be at least about 1.5 longer than the short sides. That is, the setting of the long-side length of the ferrite 31 to about 1.5 to about 5 times the short-side length has many advantages in view of a compact low-loss wide-band isolator.

Figure 24:
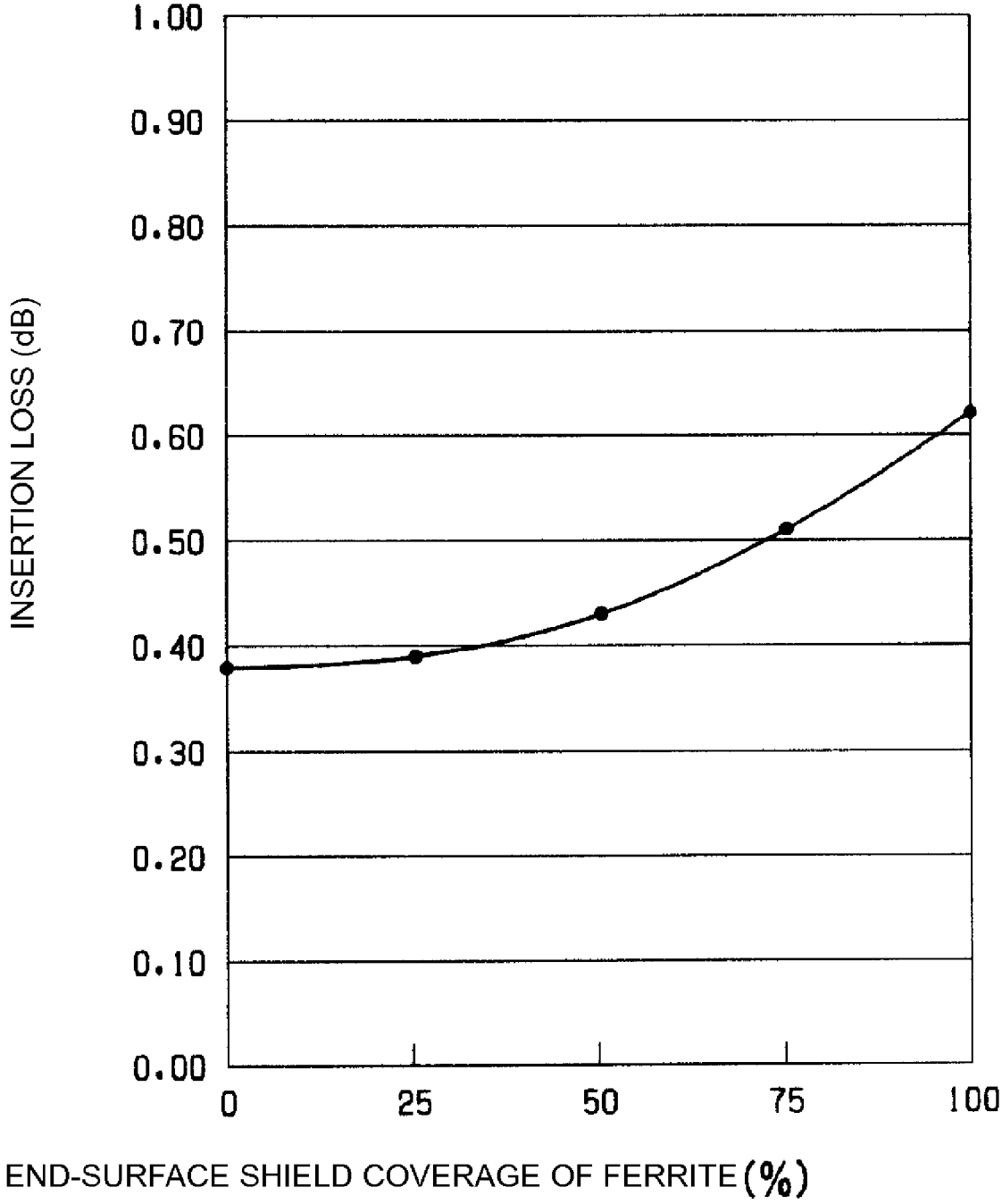
FIG. 24 is a graph showing the insertion loss in a case where the end surfaces of the ferrite are covered by a conductor.
Figure 25:
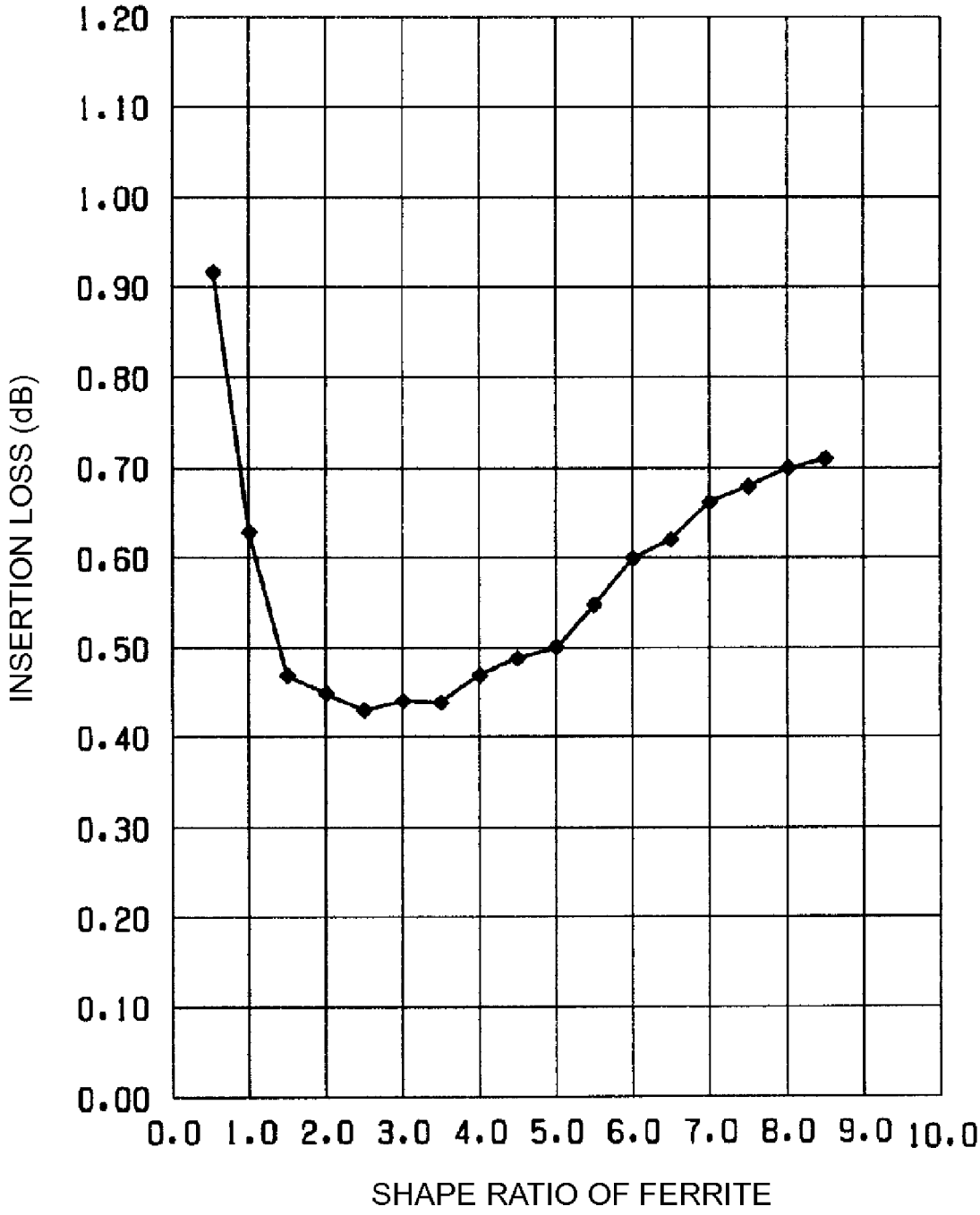
FIG. 25 is a graph showing the insertion loss with respect to the shape ratio of the ferrite when the second center electrode is wound one turn.
Figure 26:
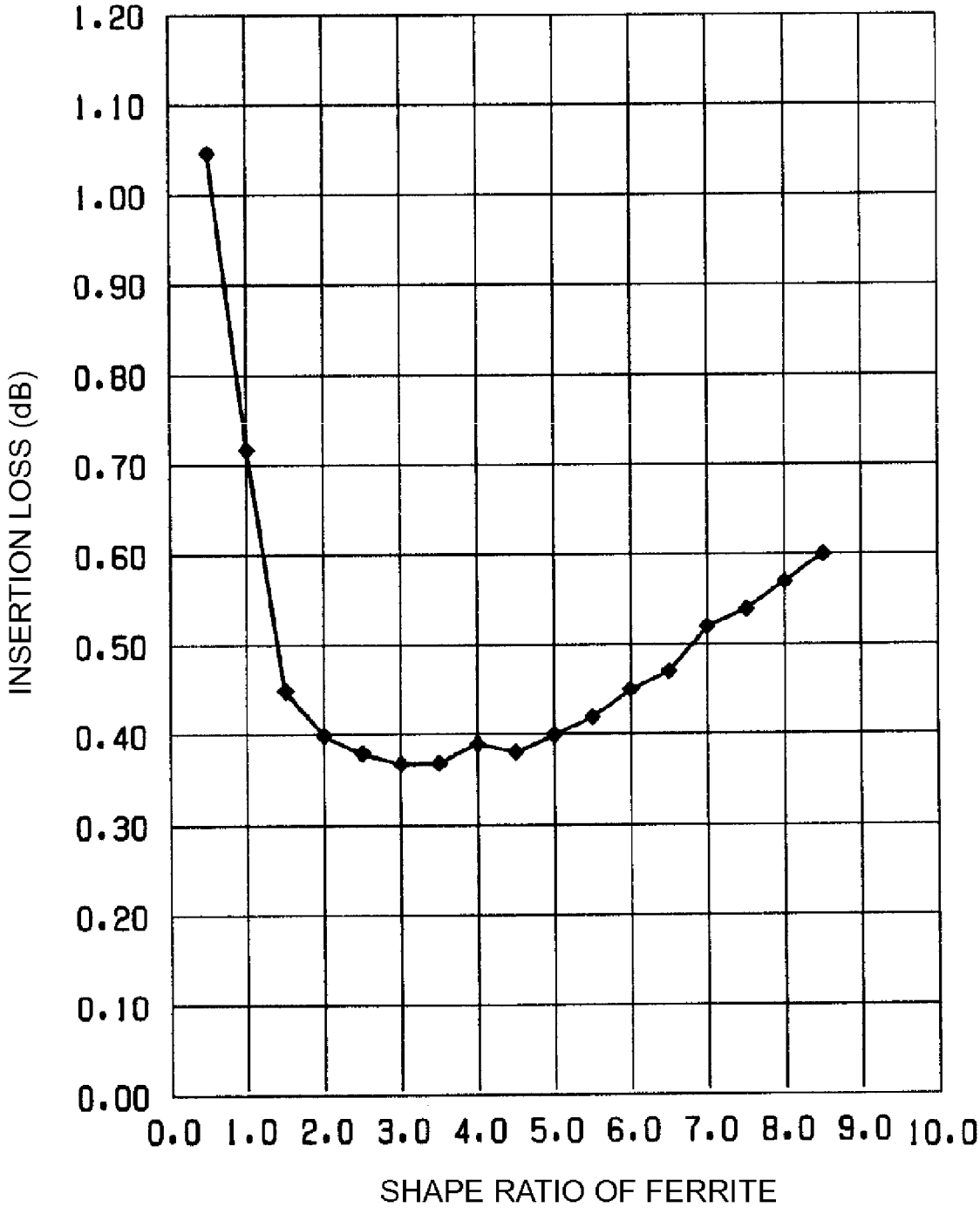
FIG. 26 is a graph showing the insertion loss with respect to the shape ratio of the ferrite when the second center electrode is wound two turns.
Figure 27:
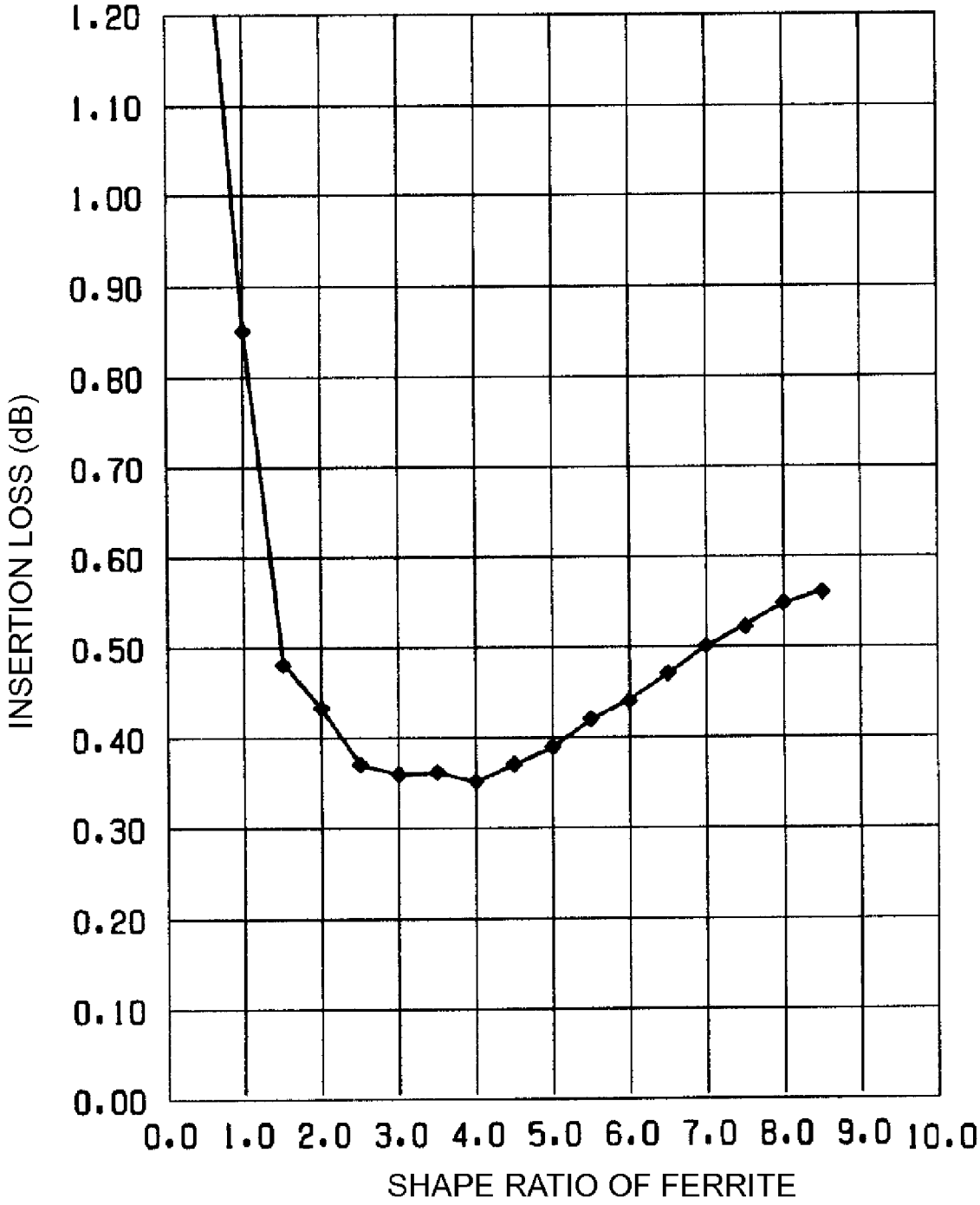
FIG. 27 is a graph showing the insertion loss with respect to the shape ratio of the ferrite when the second center electrode is wound three turns.
Figure 28:
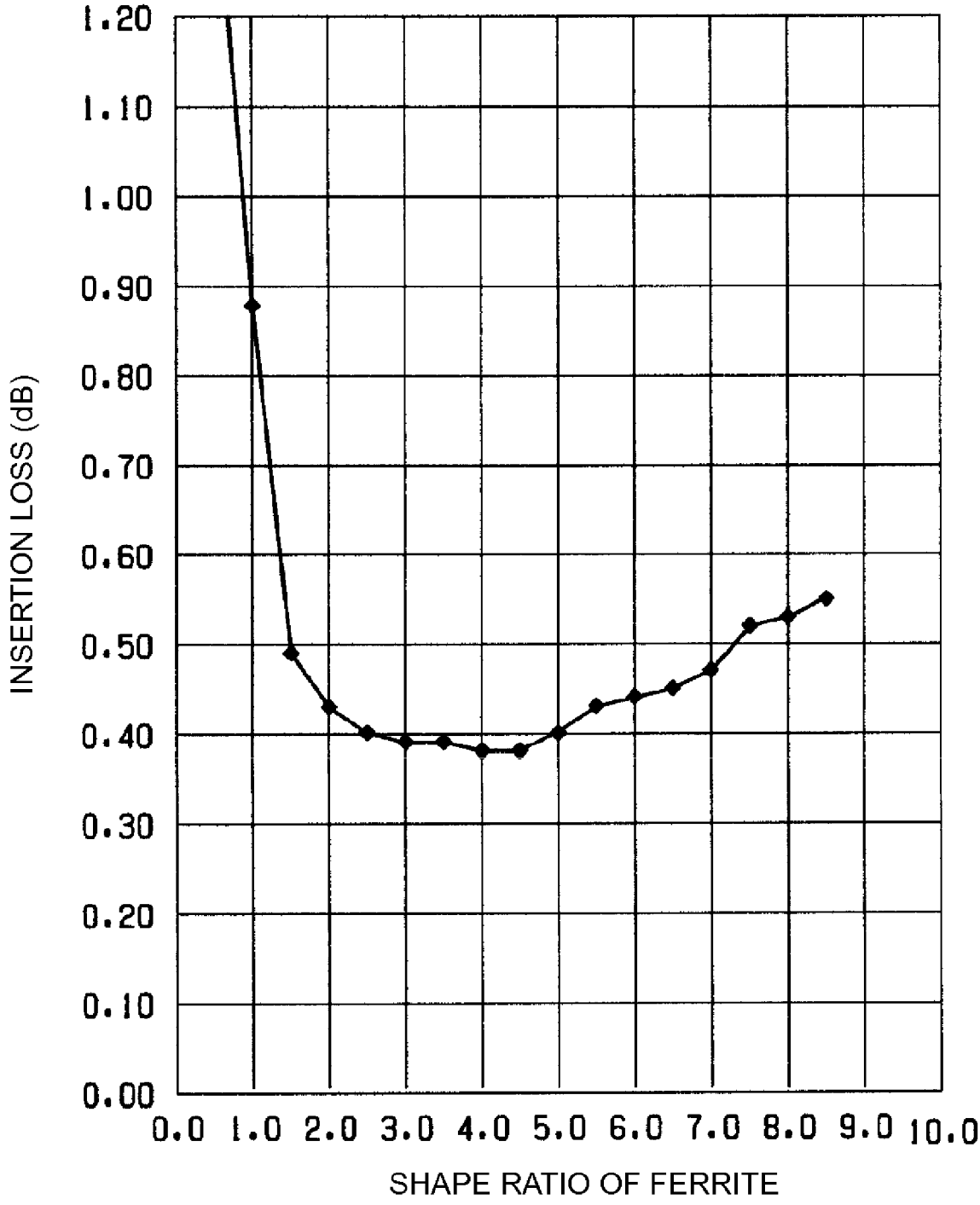
FIG. 28 is a graph showing the insertion loss with respect to the shape ratio of the ferrite when the second center electrode is wound four turns.
Figure 29:
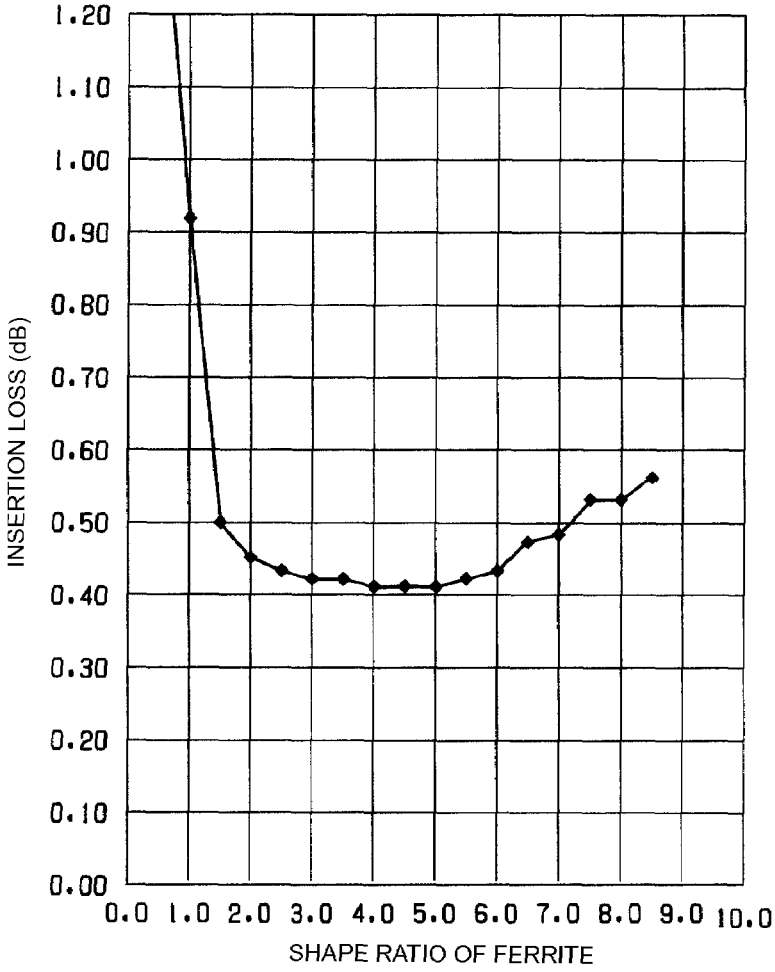
FIG. 29 is a graph showing the insertion loss with respect to the shape ratio of the ferrite when the second center electrode is wound five turns.

In the electrode-formation example shown in FIG. 18, the first center electrode 35 extends from the first principal surface 31*a* to the second principal surface 31*b* through the connection electrode 37*b* provided on the side surface 31*d*, and no electrodes are provided on the end surfaces 31*e* and 31*f*. If the end surfaces 31*e* and 31*f* are covered by a conductor, the insertion loss increases. Data indicating such transition is shown in FIG. 24. The data is obtained based on the electrode-formation example shown in FIG. 18 by measuring the degradation of the insertion loss when a center portion of the left end surface 31*e* of the ferrite 31 is shielded by a conductor. When the shield coverage is about 25% or less, substantially no degradation of the insertion loss is observed. However, the insertion loss gradually increases when the shield coverage exceeds about 25%. When the right end surface 31*f*, which is far from the second center electrode 36, is shielded by a conductor, the influence is less than that of the data shown in FIG. 24.

Results of the measurement of the insertion loss with respect to changes in the shape ratio (the ratio of the short-side length to the long-side length) of the ferrite are shown in FIGS. 25 to 29. The thickness of the ferrite is about 0.3 mm, the short-side length of the principal surfaces is about 1.0 mm, the long-side length is determined by multiplying the short-side length of about 1.0 mm by the shape ratio (as represented by the x-axis in FIGS. 25 to 29), the saturation magnetization of the ferrite is about 1000 gauss, and the center-electrode width and the direct-current bias magnetic field are set to arbitrary optimum values so that the insertion loss can be minimized under the individual conditions. The number of turns of the first center electrode is one in FIGS. 25 to 29, and the number of turns of the second center electrode is one in FIG. 25, two in FIG. 26, three in FIG. 27, four in FIG. 28, and five in FIG. 29.

As shown in FIGS. 25 to 29, the insertion loss rapidly increases when the shape ratio of the ferrite is below about 1:1.5. This tendency becomes more pronounced as the number of turns is increased. The reason for this is that, when the number of turns of the second center electrode increases, the distance between adjacent lines of the center electrode is reduced, the line width is reduced in a small-shape-ratio ferrite in order to avoid contacts of the lines of the center electrode, the equivalent series resistance increases, and the Q factor of the second center electrode decreases, thereby increasing the loss.

In a case where the distance between adjacent lines of the center electrode is relatively small or in a case where second center electrodes that are adjacent with an insulating material therebetween overlap, the self-resonance frequency of a portion of the center electrode decreases, and there may arise a problem in that a satisfactory operation may not be obtained at a target frequency.

As can be seen from FIGS. 25 to 29, the insertion loss is minimized when the shape ratio of the ferrite is about 1:3 to about 1:4. If the shape ratio is more than that range, the improvement in insertion loss is small or, rather, the insertion loss gradually increases. The reason for this is that since the insertion loss is degraded if the first center electrode is elongated over the optimum value, the length is about 3 mm to about 4 mm on one principal surface, and, if the second center electrode is wound over a wide area, an area in the high-frequency magnetic field that is not coupled to the first and second center electrodes increases. Where such a problem is avoided and the optimal coupling between the center electrodes is provided, the ends in the long-side direction of the ferrite do not contribute to the coupling between the center electrodes and the signal transmission. If the shape ratio of the ferrite is about 1:5 or more, on the other hand, because of its shape, the ferrite is likely to be broken.

The insertion loss is preferably about 0.5 dB or less. In view of such improvements in the insertion loss and the mechanical strength of the ferrite, the shape ratio of the ferrite is most preferably about 1:5 or less.

A communication apparatus according to a preferred embodiment of the present invention will be described in the context of a portable telephone.

Figure 30:
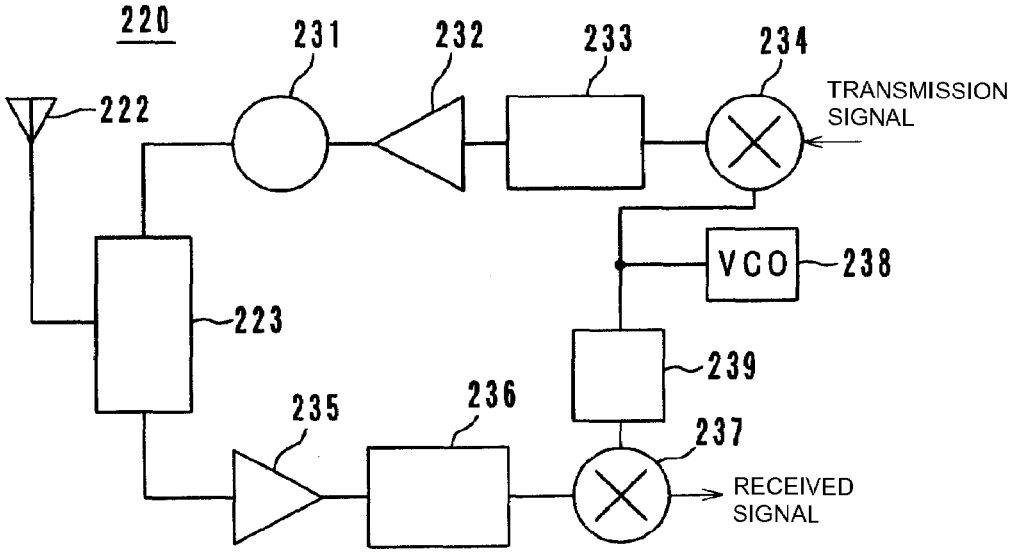
FIG. 30 is a block diagram showing a communication apparatus according to a preferred embodiment of the present invention.

FIG. 30 is an electric circuit block diagram of an RF section of a portable telephone 220. In FIG. 30, reference numeral 222 denotes an antenna device, reference numeral 223 denotes a duplexer, reference numeral 231 denotes a transmission-side isolator, reference numeral 232 denotes a transmission-side amplifier, reference numeral 233 denotes a transmission-side interstage band-pass filter, reference numeral 234 denotes a transmission-side mixer, reference numeral 235 denotes a reception-side amplifier, reference numeral 236 denotes a reception-side interstage band-pass filter, reference numeral 237 denotes a reception-side mixer, reference numeral 238 denotes a voltage controlled oscillator (VCO), and reference numeral 239 denotes a local band-pass filter.

The two-port isolator 1 can be used as the transmission-side isolator 231. By using the isolator 1, a portable telephone with low insertion loss and high electrical characteristics is achieved.

The two-port isolator and the communication apparatus according to the present invention are not limited to those in the above-described preferred embodiments, and a variety of modifications may be made without departing from the scope of the present invention.

For example, the input port P1 and the output port P2 are interchangeable by reversing N and S poles of the permanent magnets 41. While in the above-described preferred embodiments, all the matching circuit devices are preferably built in the circuit board, chip-type inductors and capacitors may be externally attached to the circuit board.

While the ferrite is preferably substantially rectangular-parallelepiped-shaped, a ferrite produced by grinding the corners by barrel-grinding or other suitable techniques may be used.

As described above, the present invention is suitable for a two-port isolator and a communication apparatus used in the microwave band, and is specifically advantageous in that the insertion loss is reduced in a wide band and a low-profile design is achieved.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A two-port isolator comprising:

a permanent magnet;

a ferrite to which a direct-current magnetic field is applied by the permanent magnet;

a first center electrode disposed on the ferrite, the first center electrode having one end electrically connected to a first input/output port and the other end electrically connected to a second input/output port;

a second center electrode disposed on the ferrite so as to cross the first center electrode in an electrically insulated manner, the second center electrode having one end electrically connected to the second input/output port and the other end electrically connected to a third port as a ground;

a first capacitor electrically connected between the first input/output port and the second input/output port;

a termination resistor electrically connected between the first input/output port and the second input/output port;

a second capacitor electrically connected between the second input/output port and the third port; and a circuit board including the first and second capacitors and the termination resistor; wherein the ferrite has a first principal surface and a second principal surface that are substantially parallel to each other, a long-side length of the first principal surface and the second principal surface being about 1.5 to about 5 times a short-side length, the first and second principal surfaces being substantially vertically disposed on the circuit board;

the permanent magnet is disposed on the circuit board so as to apply a magnetic field to the first and second principal surfaces of the ferrite substantially vertically to the principal surfaces; and the second center electrode is wound between one and four turns around the ferrite.

2. The two-port isolator according to claim 1, wherein a matching capacitor is further electrically connected between at least one of a node of the first center electrode and the first capacitor and the first input/output port and a node of the first and second center electrodes and the second input/output port.

3. The two-port isolator according to claim 1, wherein a matching inductor is electrically connected between a node of the second center electrode and the second capacitor and the third port.

4. The two-port isolator according to claim 1, wherein a series circuit defined by an inductor and a capacitor is electrically connected between one of the first input/output port and the ground and the second input/output port and the ground.

5. The two-port isolator according to claim 1, wherein the ferrite has a thickness that is about 15% to about 30% of a height of the ferrite.

6. The two-port isolator according to claim 1, wherein the second center electrode is wound on the first and second principal surfaces of the ferrite and both side surfaces adjoining the long sides of the principal surfaces.

7. The two-port isolator according to claim 1, wherein a connection electrode of the first center electrode that is disposed on an end surface adjoining the short sides of the first and second principal surfaces of the ferrite has an area that is about 25% or less of the area of the end surface.

8. The two-port isolator according to claim 1, wherein both end surfaces adjoining the short sides of the first and second principal surfaces of the ferrite do not include the first and second center electrodes and a connection electrode.

9. The two-port isolator according to claim 1, wherein a connection electrode provided on one side surface adjoining the long sides of the first and second principal surfaces of the ferrite has an area that is about 25% or less of the area of the principal surfaces of the ferrite.

10. The two-port isolator according to claim 1, wherein connection electrodes of the first and second center electrodes are provided on one side surface adjoining the long sides of the first and second principal surfaces of the ferrite.

11. The two-port isolator according to claim 1, wherein a winding axis of the second center electrode is located in a plane that is substantially perpendicular to the short sides of the first and second principal surfaces of the ferrite.

12. The two-port isolator according to claim 1, wherein a winding axis of the second center electrode is located in a direction that is substantially perpendicular to the magnetic field applied from the permanent magnet.

13. The two-port isolator according to claim 1, wherein the first and second center electrodes include one of film-like electrodes, metal-foil electrodes, and metal-plate electrodes provided on the ferrite.

14. The two-port isolator according to claim 1, wherein the ferrite has one of a substantially rectangular-parallelepiped shape and a configuration included ground corners.

15. A communication apparatus comprising the two-port isolator according to claim 1.

16. The two-port isolator according to claim 1, wherein the first and second center electrodes are formed by one of printing, transferring, and photolithography of one of a thick film, thin film, and foil on the ferrite.

17. The two-port isolator according to claim 16, wherein the one of the thick film, thin film, and the foil includes at least one of silver, copper, gold, nickel, platinum, and palladium.

* * * * *